United States Patent [19]

Dolan

[11] 4,418,023

[45] Nov. 29, 1983

[54] COOLING TOWER APPARATUS

[75] Inventor: Norman E. Dolan, Santa Rosa, Calif.

[73] Assignee: Ecodyne Corporation, Chicago, Ill.

[21] Appl. No.: 371,587

[22] Filed: Apr. 26, 1982

[51] Int. Cl.[3] ..... B01F 3/04

[52] U.S. Cl. ..... 261/109; 261/DIG. 11

[58] Field of Search ..... 261/109, DIG. 11

[56] References Cited

U.S. PATENT DOCUMENTS

| | | | |
|---|---|---|---|
| 2,010,980 | 8/1935 | Coulson | 261/109 |
| 2,808,243 | 10/1957 | Slough et al. | 261/109 |
| 3,637,195 | 1/1972 | Blazer et al. | 261/109 |
| 4,164,256 | 8/1979 | Kelp | 261/109 |
| 4,173,605 | 11/1979 | Long | 261/109 |
| 4,380,517 | 4/1983 | Bosne | 261/109 |

FOREIGN PATENT DOCUMENTS

| | | | |
|---|---|---|---|
| 2430475 | 1/1975 | Fed. Rep. of Germany | 261/109 |
| 55-131699 | 10/1980 | Japan | 261/DIG. 11 |

*Primary Examiner*—Tim R. Miles

*Attorney, Agent, or Firm*—Dressler, Goldsmith, Shore, Sutker & Milnamow, Ltd.

[57] ABSTRACT

An air inlet control assembly for cooling towers including air control panel members pivotally secured to the louver blades. The panel members are pivotted between a down position wherein they preclude the entry of air between the louver blades and an up position wherein they permit the entry of air between the louver blades. The panel members are formed from a lightweight fiberglass material and include means to direct liquid away from the outer edge of the louver blade when the panel member is in its down position. Cover members extend across the louver blade support arms and are releasably secured to the adjacent panel members when the panel members are in their down positions.

15 Claims, 8 Drawing Figures

Fig. 1.
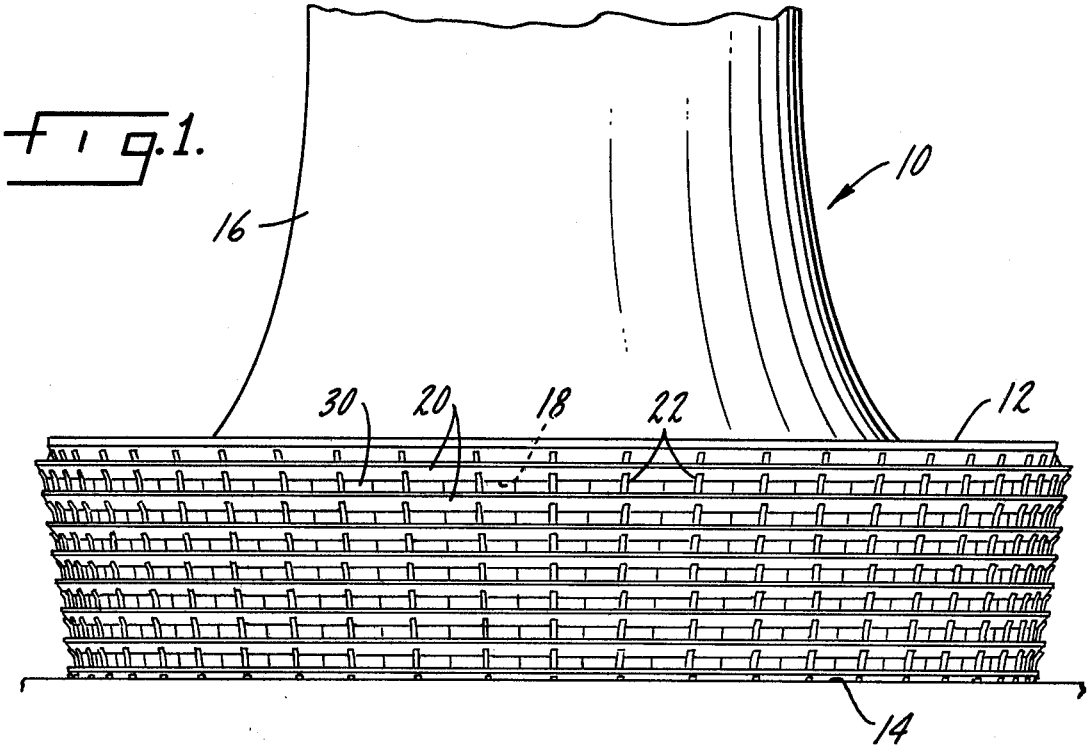
Fig. 5.
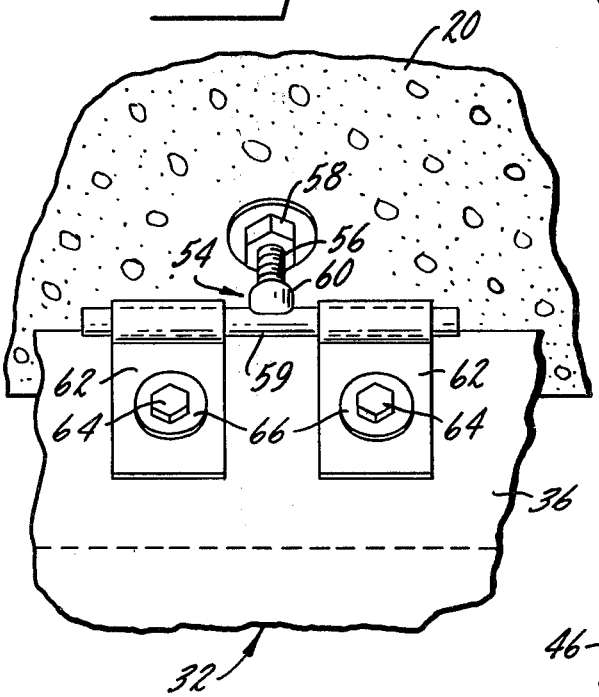
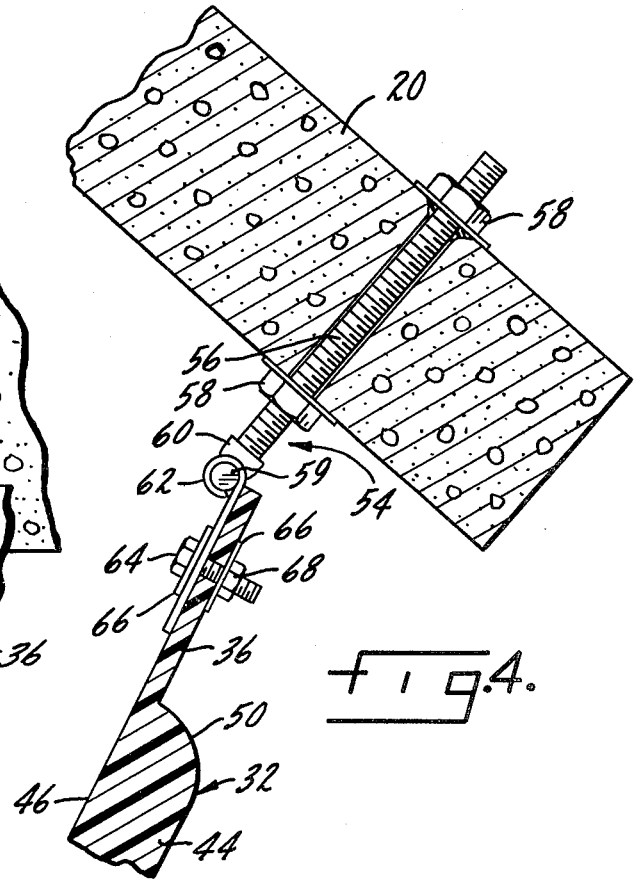
Fig. 4.

Fig. 2.
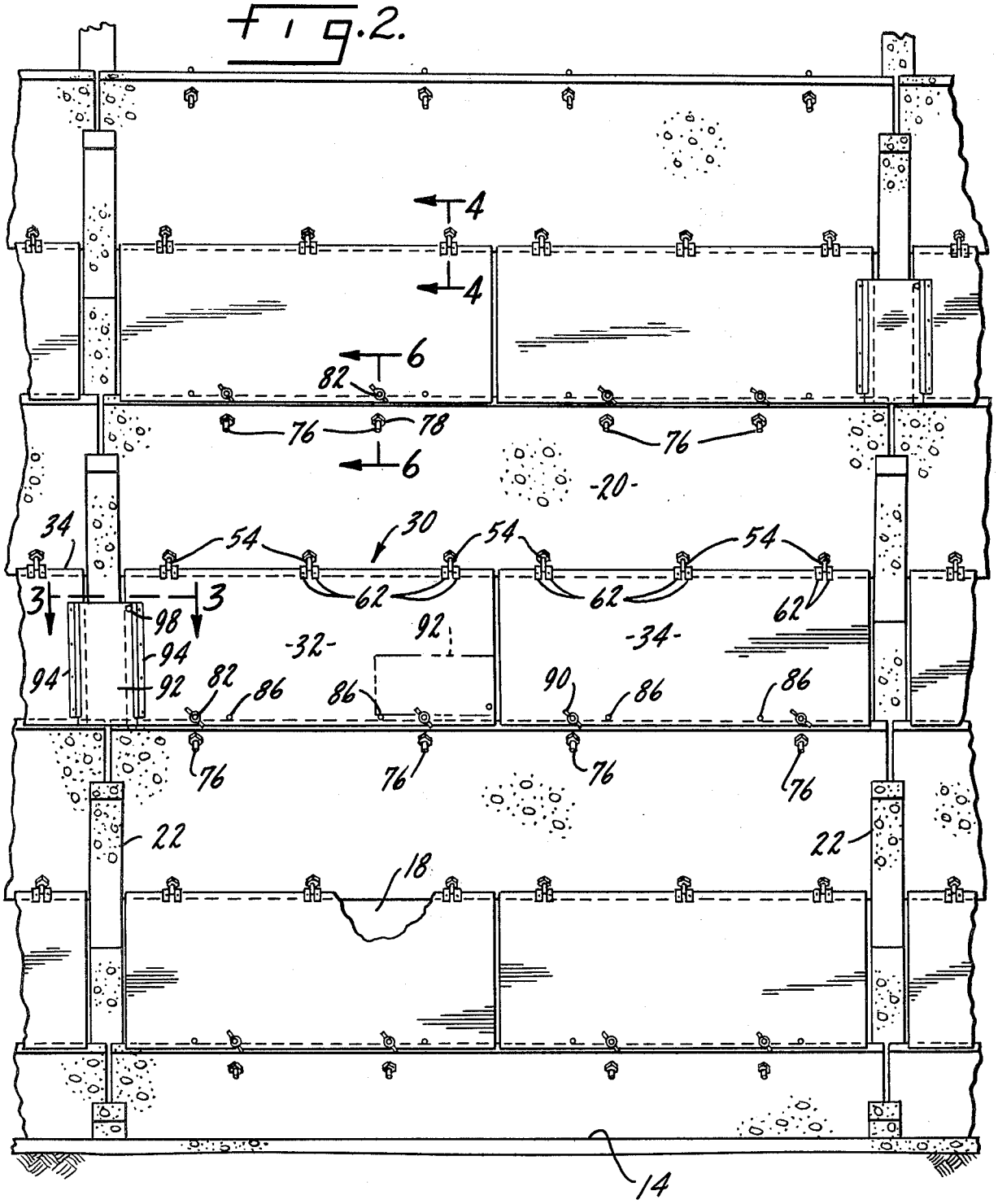
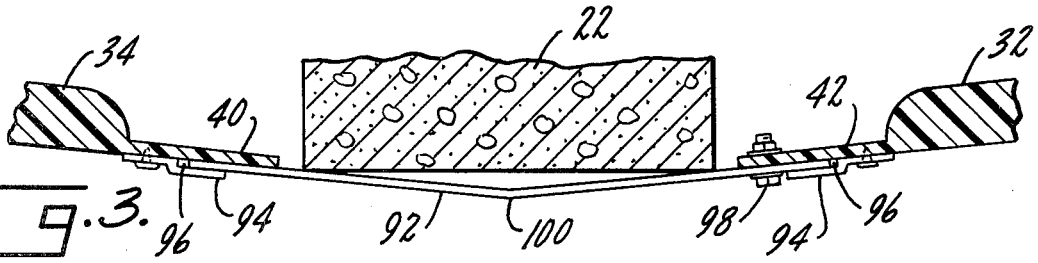
Fig. 3.

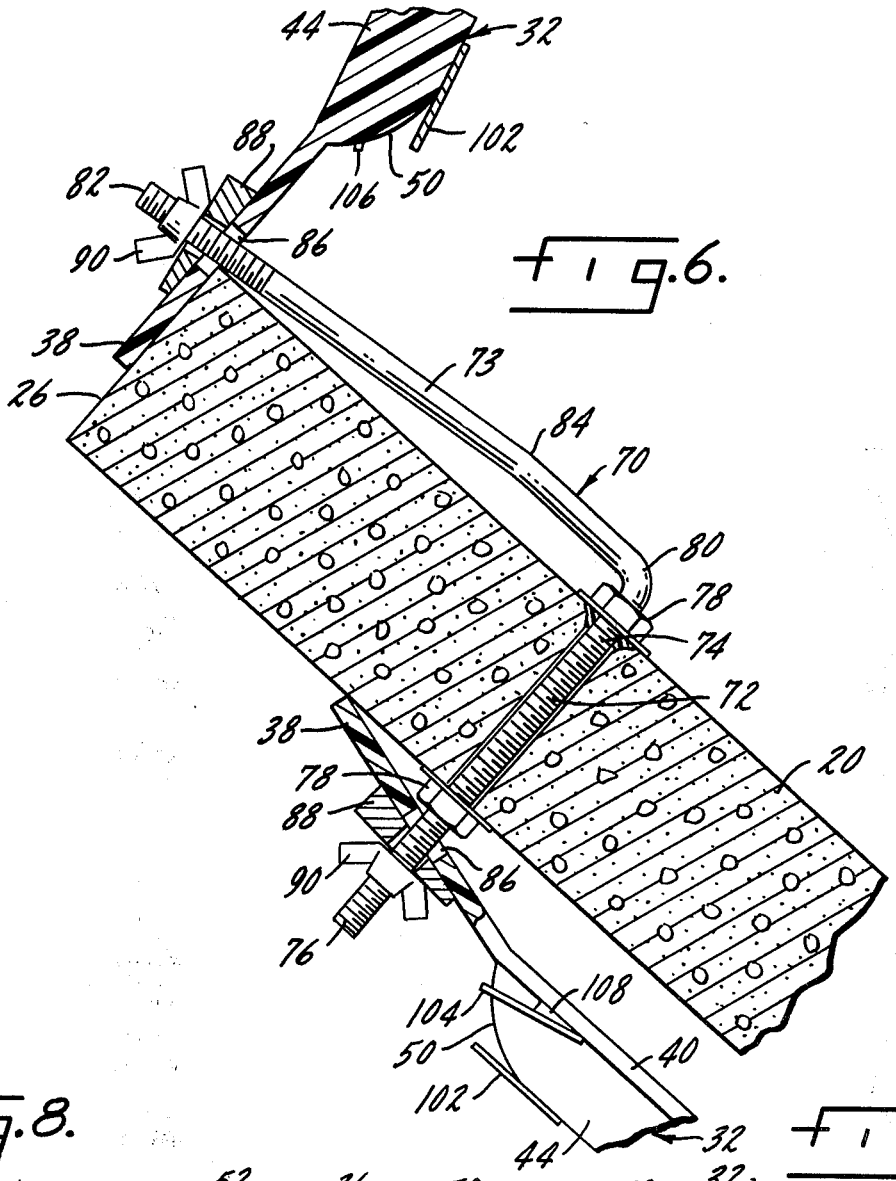
fig.6.
fig.8.
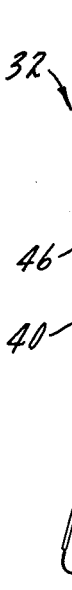
fig.7.
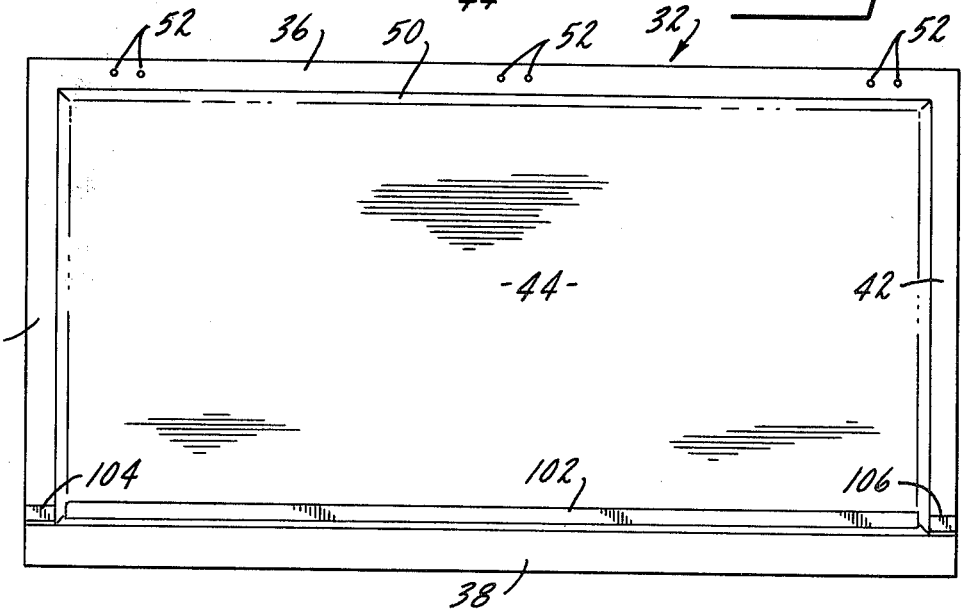

COOLING TOWER APPARATUS

BACKGROUND OF THE INVENTION

This invention relates generally to mechanical and natural draft liquid cooling towers of the crossflow and counterflow types and more particularly to an improved inlet air control assembly for such towers.

In general, liquid cooling towers have a shell or enclosure defining a fill area in which is supported fill strips of various configurations. Liquid to be cooled descends through the fill area whereupon it is cooled by evaporation from the surface of droplets and films and by sensible heat transfer from water surfaces to air which is circulated through the fill area. The air is circulated into the tower through an air inlet and then through the fill area and exits through an air outlet. The air is forced into the air inlet by either mechanical means, such as fans, or by creating a natural draft by use of a natural draft chimney. In either case, the air enters between louver blades which are associated with the air inlet and exits through some form of stack or chimney associated with the air outlet.

There are a number of factors which determine the degree of cooling of a cooling tower design; among them being the quantity and temperature of the entering air. Needless to say, the lower the temperature and the greater the quantity of the inlet air, the greater the cooling capacity of the tower. Accordingly, it is common practice to design cooling towers which have the required capacity under conditions normally encountered during the hot summer months. That is, the air flow through the tower is designed such that a sufficient quantity of the hot summer air is drawn through the fill area to cool the liquid to the desired temperature. However, it has been found that when such towers are operated under cold winter conditions, the cold entering air causes the liquid adjacent to the air inlet to freeze on the louver blades, fill, and other support structures. The ice loads so created can be so large as to cause failure of the tower elements.

In such instances it is necessary to reduce the quantity of air which enters the tower through the air inlet. In the case of mechanical draft towers the fans can be either slowed down or shut off. However, in the case of natural draft towers there is no means to reduce the quantity of air which enters the tower. It has heretofore been proposed to install permanent wood panel members across some of the air inlet louver blades during the winter months to reduce the air flow into the tower. Although such wood panel members have been somewhat effective, it has been found the necessity to install and remove them each season is quite burdensome.

SUMMARY OF THE INVENTION

It is a primary object of the invention to provide an improved inlet air control assembly for a cooling tower.

Another object is to provide such an inlet air control assembly that permits flexibility of operation.

A further object is to provide such an inlet air control assembly that can be installed on existing towers.

An even further object is to provide a panel member for use in such assembly that is strong, durable, streamlined, relatively low cost and is easily installed and maintained.

Another object is to provide such a panel member which includes means to prevent liquid from running down the panel and out on to the louver blade where it may form ice.

These and other objects are realized in accordance with the invention.

Briefly stated, the inlet air control assembly in accordance with the invention includes a plurality of vertically spaced louver blades secured to horizontally spaced louver blade support arms. Air control panel members are pivotally secured to the louver blades. The panel members are pivotted between a down position wherein they preclude the entry of air between the louver blades and an up position wherein they permit the entry of air between the louver blades.

More specifically, the panel members are formed from a lightweight fiberglass material and have first and second generally horizontal edge portions and first and second generally vertical edge portions. The horizontal and vertical edge portions are generally in a common plane. A body portion, formed within the area defined by the edge portions, has a generally flat outer surface in the same plane as the edge portions and a generally concave inner surface lying outside of such common plane. The first horizontal edge portion is provided with means to pivotally secure same to a louver blade. The second horizontal edge portion is bent outwardly to contact the outer edge of a louver blade positioned immediately therebelow when the panel member is in its down position.

In accordance with a preferred form of the invention, a first generally flat stripper plate is secured to the inner surface of the body portion of the panel member to direct liquid away from the outer edge of the louver blade when the panel member is in its down position. Similarly, second and third generally flat stripper plates are secured respectively to the first and second vertical edge portions.

In accordance with a further feature of the invention, cover members extend across the louver blade support arms and are releasably secured to the adjacent panel members on either side of the louver blade support arms when the panel members are in their down positions. The panel members are provided with bracket members to facilitate the installation and removal of the cover members.

All the above-mentioned and additional features and objects of the invention, together with the details of construction, will be more fully understood from the following detailed description of a preferred embodiment of the invention.

DESCRIPTION OF THE DRAWINGS

FIG. 1 is a elevational view of a portion of a cooling tower, incorporating the inlet air control assembly in accordance with the invention;

FIG. 2 is an enlarged elevational view of a portion of the air inlet section of the cooling tower shown in FIG. 1, with the control panels in their down position;

FIG. 3 is a sectional view taken along line 3—3 in FIG. 2,

FIG. 4 is a sectional view taken along line 4—4 in FIG. 2, showing the attachment of a control panel to a louver blade;

FIG. 5 is a side elevational view of the arrangement shown in FIG. 4;

FIG. 6 is a sectional view taken along line 6—6 in FIG. 2, showing a portion of a louver blade with a control panel attached thereto in its down position and a control panel attached thereto in its up position;

FIG. 7 is an elevational view of the rear surface of a control panel constructed in accordance with the invention; and FIG. 8 is a side elevational view of the control panel shown in FIG. 7.

DESCRIPTION OF A PREFERRED EMBODIMEMT

The inlet air control assembly in accordance with the present invention will be disclosed in conjunction with a natural draft crossflow cooling tower, however, it is anticipated that the invention may be also used on mechanically assisted cooling towers and counterflow cooling towers. The adaption of the invention for use on such towers is well within the skill of one skilled in the art.

FIG. 1 shows a natural draft crossflow cooling tower 10 having a hot water distribution area 12, a fill or packing area therebelow (not specifically shown) and a cold water basin 14, positioned below the fill area. Water to be cooled is pumped into distribution area 12 from which it is discharged under the influence of gravity through suitable metering outlets into and through the fill area. After falling through and over the fill or packing, the cooled water is collected in basin 14. A natural draft chimney 16 draws air through the tower for discharge up and out of the chimney. Air enters the outside wall of the fill area through inlet openings 18 defined by vertically spaced rows of louver blades 20 in accordance with this invention. The air passes through the fill or packing and the falling water in the fill area, where the water is cooled in the usual manner. The louver blades 20 direct and promote relatively uniform flow of air into the tower and also catch splashing or wind blown water and cause it to drain into basin 14.

Referring to FIGS. 1 and 2, louver blades 20 are supported at their ends by horizontally spaced, inclined louver blade support arms 22. Support arms 22 are vertically spaced in horizontal rows around the outside of the fill area. The louver blades 20 are preferably formed with a generally flat outer edge 26. The louver panels 20 are preferably inclined away from the tower at an angle in the range of 30°–60° to the vertical. As seen in FIG. 1, the particular tower illustrated therein has eight rows of louver blades 20 which define eight rows of inlet openings 18 therebetween. The air which is drawn into the tower passes through inlet openings 18.

In accordance with the present invention an inlet air control assembly indicated generally at 30, is provided at all or some of the inlet openings 18. The assemblies 30 control the amount of air which is permitted to enter the respective inlet openings 18. One such assembly 30 will now be disclosed with the requisite detail, it being understood that the other assemblies 30 are of identical construction.

Assembly 30, in its presently considered preferred form, includes a pair of panel members 32 and 34, which are positioned adjacent to each other in an end to end relationship, as best seen in FIG. 2. Panel members 32 and 34 are of identical construction and, accordingly, only the construction of panel member 32 will be discussed herein. Referring to FIGS. 3, 6, 7 and 8, panel member 32 is a substantially rectangular member having an upper or first generally horizontal edge portion 36, a lower or second generally horizontal edge portion 38, and generally vertical first and second edge portions 40 and 42. Panel member 32 includes a body portion 44 formed within the area defined between the edge portions 36, 38, 40 and 42. Body portion 44 defines a generally flat outer surface 46 with edge portions 36, 38, 40 and 42. Body portion 44 defines a generally convex inner surface 48 lying outside of a common plane which passes through the edge portions 36, 38, 40 and 42. The edges of the body portion 44 are curved inwardly as indicated at 50. Lower edge portion 38 is bent outwardly and three pairs of openings 52 are formed through upper edge portion 36, the significance and purpose of which will hereinbelow become more apparent. Panel member 32 is preferably fabricated of a fiberglass sandwich design, having a one inch thick continuous piece rigid polyurethane foam core portion which is sandwiched between one eighth inch thick random chopped strand glass reinforced polyester skin portions.

Referring to FIGS. 2, 4 and 5, panel members 32 and 34 are pivotally mounted to louver blades 20. In accordance with a preferred form of the invention, tee-bolts 54 extend through openings formed in the lower portion of the louver blades 20, in general alignment with the openings 52 in the panel members 32 and 34. Tee-bolt 54 is formed with a shank portion 56, which is threaded at both ends for receipt of nut and washer assemblies 58 to sandwich louver blade 20 therebetween. Bar portion 59 is secured to the lower end of the shank portion 56 through a centrally disposed bolt head portion 60. Bar portion 59 serves as the pivot pin about which the panel members pivotally swing. Hinge members 62 are secured to the edge portion 36 of the panel members by bolts 64, washers 66 and nuts 68. Each bar portion 59 receives a pair of hinge members 62 in a manner which permits the pivotal movement of the panel member 32 about the substantially horizontal axis passing through the bar portion 59. As will hereinbelow become more apparent, the panel members 32 and 34 are movable between down or lowered positions wherein the lower edges 38 are in contact with a louver blade 20 immediately below, as seen in FIGS. 2 and 6, and up or raised positions wherein the lower edges 38 are in contact with a louver blade 20 immediately above, as seen in FIG. 6.

Referring to FIGS. 2 and 6, in accordance with a preferred form of the invention, horizontally spaced L-bolt members 70 extend through openings formed in the upper portions of the louver blades 20. L-bolt member 70 is formed with sections 72 and 73. Sections 72 is threaded at its inner end 74 and outer end 76 to receive washer and nut assemblies 78 so as to sandwich blade 20 therebetween. As seen in FIG. 6, the free end 76 extends outward beyond the assembly 78. Section 73 has an inner end 80 integral with a corresponding inner end 74 and an outer end 82 which extend beyond the outer edge 26 of louver blade 20. Section 73 is preferably bent at 84 such that the outer end 82 is in contact with the outer edge 26. The outer end 82 extends outwardly beyond the edge 26 and the end 76 extends downwardly from the lower surface of the louver blade 20, the significance of which is discussed immediately hereinbelow.

Referring to FIG. 2, it will be noted that the L-bolt members 70 passing through each level of louver blades 20 are horizontally offset from the corresponding L-bolt members 70 passing through the louver blades 20 in the level immediately above and immediately below. In essence, the L-bolt members 70 passing through every other level of louver blades 20 are in substantial vertical alignment. The lower edge portions 38 of the panel members 32 and 34 have holes 86 drilled therethrough in respective vertical alignment with an ends 76 or 82 of the L-bolt members 70 immediately above and immediately below. Therefore, as best seen in FIG. 6, when the panel members 32 and 34 are in their lowered position, the ends 82 extend through a corresponding hole 86. The panel members are secured in such position by a bevelled washer 88 and a wing nut 90. It should be noted that the edge portions 38 are bent such that they contact the surface of the edges 26 of the louver blades 20. When the panel members are pivotted into their raised positions, upon removal of washer 88 and nut 90, the ends 76 extend through a corresponding hole 86. Similarly, a bevelled washer 88 and a nut 90 secure the panel members in their raised positions. In accordance with the above, the L-bolt members 70 serve the dual function of retaining the panel members in both their raised and lowered positions. It should be noted that staggering of the positioning of the L-bolt members 70 of adjacent levels of louver blades 20 is necessitated by the fact that the particular cooling tower disclosed has a circular outer wall. The present invention contemplates use of the assembly 30 on cooling towers having flat outer walls, in which case it is not necessary to stagger the members 70 and only one hole 86 is required to correspond to each member 70.

Referring to FIGS. 2 and 3, a cover plate 92 is provided to extend across the support arms 22 and seal the open spaces between the edges of the panel members 32 and 34 and the corresponding support arm 22. The edge portions 40 and 42 of the panel members have a bent bracket members 94 secured thereto, which define vertically extending open recesses 96 in facing relationship to the support arm 22. Cover plate 92 is releasably received in the recesses 96 of a corresponding pair of bracket members 94. Plate 92 is secured in place by a nut and bolt assembly 98, which extends through plate 92 and into the panel member. The cover plate 92 is only secured in place when the panel members 32 and 34 are in their down positions. As is quite apparent, it is necessary to remove the cover plate 92 before the panel members are positioned into their raised position. As seen in phantom lines in FIG. 2, it is contemplated that the cover plates 92 may be secured to the panel members by a nut and bolt assembly 98 for storage thereof when not in use. In the particular tower illustrated in the Figures, it is necessary to form the cover plate 92 with an intermediate bent 100 to permit same to extend across the support arm 22. By positioning a cover plate 92 across each support arm when the corresponding panel members are in their down positions, inlet air is precluded from entering into the tower through the spaces between the edges of the panel members 32 and 34 and the support arm 22.

Referring to FIGS. 6, 7 and 8, in accordance with a preferred form of the invention, stripper plates are suitably secured to the inner surface of the panel members adjacent the lower edges portions thereof. The stripper plates serve to direct splashing water which contacts the inner surface of the panel members away from the outer edges of the louver blades. In so doing, the water is prevented from running down the panel members and out onto the louver blades where it may form ice under cold operating conditions. More specifically, a generally flat stripper plate 102 is suitably secured to the body portion 44 adjacent to the edge portion 38. Stripper plate 102 extends to the curved portion 50 and, as best seen in FIG. 6, thereby directs water which flows down the panel members 32 and 34 onto a portion of the louver blade 20 spaced from the edge portion 26. For the same purposes, stripper plates 104 and 106 are suitably secured to the edge portions 40 and 42 adjacent to stripper plate 102. Stripper plates 104 and 106 are inclined downwardly and inwardly by wedge members 108.

The air inlet assembly 30, in accordance with the teachings of the invention, provides a means to increase the efficiency of operation of a cooling tower under varying ambient temperature conditions. During summer conditions, it is contemplated that most, if not all, of the panel members will be positioned in their raised or inoperative positions. In so doing, the quantity of inlet air drawn into and through the tower is maximized. During winter conditions, it is contemplated that most, if not all, of the panel members will be positioned in their down or operative positions. In so doing, the quantity of cold inlet air drawn into and through the tower will materially reduced. This will substantially eliminate the formation of ice on the louver blades and the fill assembly and eliminate the resultant damage caused by the increased loading on these elements. The ease in which the panel members can be moved between their operative and inoperative positions, permits periodic fine tuning of the quantity of air which is allowed to enter the tower as ambient air temperature changes. The specific design of the air inlet assembly 30 and construction thereof permits the assembly 30 to truly operate as a means of air inlet control. The construction of the panel members 32 and 34 provides a structure which is light in weight and, therefore, easily installed and operated, while still being able to withstand high wind loads which may be encountered.

While the present invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. In a liquid cooling tower having means for delivering liquid and for causing such liquid to fall within said tower, an air inlet, an air outlet, means for causing air to flow from said inlet to said outlet so as to intersect the liquid falling within the tower, and an improved inlet air control assembly at said air inlet, comprising:

(a) a plurality of horizontally spaced, generally inclined louver blade support arms;

(b) a plurality of vertically spaced rows of louver blades secured to said louver blade support arms; and (c) air control panels secured to at least some of said louver blades, said air control panels comprising:

(i) a substantially rectangular panel member having a first generally horizontal edge portion pivotally secured to said louver blade, said panel member being pivotable between an up position and a down position;

(ii) said panel member cooperates with the louver blade immediately therebelow when in said down position so as to prevent the entry of air between such louver blades; and (iii) said panel member permits the entry of air between said louver blade and the louver blade immediately therebelow when in said up position.

2. The invention as defined in claim 1 wherein a plurality of Tee-bolt members extend through the lower portion of said louver blade and said first horizontal edge of said panel members have hinge members secured thereto for pivotal receipt of a portion of said Tee-bolt member.

3. The invention as defined in claim 1 wherein a pair of said panel members are positioned adjacent one another in an end to end relationship between said louver blade support arms.

4. The invention as defined in claim 1 wherein said panel member has a second horizontal edge which is releasably secured to said louver blade immediately therebelow when said panel member is in said down position.

5. The invention as defined in claim 4 wherein L-shaped bolt members extend through said louver blades adjacent the upper edges thereof, said L-shaped bolt members have first ends for receipt through holes in said second horizontal edge of said panel member when said panel member is in its up position and second ends for receipt through holes in said second horizontal edge of a panel member secured to the louver blade immediately thereabove when such panel member is in its down position.

6. The invention as defined in claim 1 wherein cover plates extend across said louver blade support arms and are releasably secured to the adjacent panel members on either side of said louver blade support arms when said panel members are in their down positions.

7. The invention as defined in claim 6 wherein said panel plates have bracket members secured thereto adjacent said blade support arms and said cover members are releasably received by said bracket members.

8. The invention as defined in claim 7 wherein said cover plates are bent to extend between the bracket members of adjacent panel members and over said blade support arms.

9. The invention as defined in claim 1 wherein said panel members are formed with a generally flat outer surface and an inner surface with generally flat peripheral edge portions lying generally in a common plane and a body portion lying outside of said common plane.

10. The invention as defined in claim 9 wherein said body portion is generally convex.

11. The invention as defined in claim 9 wherein said panel member has a second generally horizontal edge portion which is bent slightly outwardly so as to contact the outer edge of a louver blade in a common plane when said panel member is in said down position.

12. The invention as defined in claim 11 wherein said panel member is formed from a fiberglass material.

13. The invention as defined in claim 11 wherein said panel member is formed with a foam core portion which is sandwiched between random chopped strand glass reinforced skin portions.

14. The invention as defined in claim 11 wherein the edge of said body portion adjacent said second horizontal edge portion is formed with a curved portion and a first generally flat stripper plate is provided on said body portion which extends over at least a portion of said curved portion.

15. The invention as defined in claim 14 wherein said panel member has first and second generally vertical edge portions and said first and second generally vertical edge portions are respectively provided with second and third generally flat stripper plates which extend downwardly and inwardly adjacent said first generally flat stripper plate.

* * * * *